US008199944B2

(12) United States Patent
Höcht et al.

(10) Patent No.: US 8,199,944 B2
(45) Date of Patent: Jun. 12, 2012

(54) METHOD FOR OPERATING A HEARING DEVICE

(75) Inventors: Philipp Höcht, Lauf (DE); Wolfgang Sörgel, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1029 days.

(21) Appl. No.: 12/075,720

(22) Filed: Mar. 13, 2008

(65) Prior Publication Data

US 2008/0232619 A1 Sep. 25, 2008

(30) Foreign Application Priority Data

Mar. 20, 2007 (DE) ..... 10 2007 013 394

(51) Int. Cl.
*H04R 25/00* (2006.01)

(52) U.S. Cl. ..... 381/312; 381/314; 381/23.1; 381/323

(58) Field of Classification Search ..... 381/312
See application file for complete search history.

(56) References Cited

U.S. PATENT DOCUMENTS

| | | | | |
|---|---|---|---|---|
| 4,396,806 | A | 8/1983 | Anderson | |
| 4,737,669 | A * | 4/1988 | Austin | 327/143 |
| 5,167,236 | A * | 12/1992 | Junker | 600/559 |
| 7,031,481 | B2 * | 4/2006 | Mortensen | 381/312 |
| 7,308,107 | B2 * | 12/2007 | Menzl et al. | 381/312 |
| 2003/0072465 | A1 * | 4/2003 | Fischer et al. | 381/317 |
| 2004/0196992 | A1 * | 10/2004 | Ryan | 381/312 |
| 2005/0004801 | A1 | 1/2005 | Liebermann | |
| 2005/0281424 | A1 * | 12/2005 | Rass | 381/312 |
| 2006/0029244 | A1 * | 2/2006 | Niederdrank | 381/312 |

FOREIGN PATENT DOCUMENTS

| | | | |
|---|---|---|---|
| DE | 19526175 | C1 | 8/1996 |
| DE | 122004025691 | B3 | 8/2005 |
| DE | 102005006662 | A1 | 8/2006 |
| EP | 1 310 138 | B1 | 5/2003 |
| EP | 1 638 368 | A1 | 3/2006 |
| WO | 0213576 | A1 | 2/2002 |
| WO | WO 0230154 | A1 | 4/2002 |

OTHER PUBLICATIONS

GN ReSound Operating Instructions Metrix mini MX60-DI, Mar. 2006, pp. 1-32.
Sharp Corporation, Sharp AR-M165 and AR-M207 Digital-Multifunctional System Handbook, 2004, pp. 1-74 of 105 pages.
Sharp Corporation, Sharp AR-M165 and AR-M207 Digital-Multifunctional System Handbook, 2004, 75-105 of 105 pages.
Communication from European Patent Office stated cited references, Feb. 7, 2012 pp. 1-6.

* cited by examiner

*Primary Examiner* — Brian Ensey
*Assistant Examiner* — Taunya McCarty

(57) ABSTRACT

An unintentional adjustment of the user-controlled control elements on the device can result within the scope of the activation of a hearing device, after a switch-on delay has elapsed. To reduce this risk, a delay in the release of the user-controlled control elements attached to the device is provided in accordance with the invention in addition to the said switch-on delay.

18 Claims, 1 Drawing Sheet

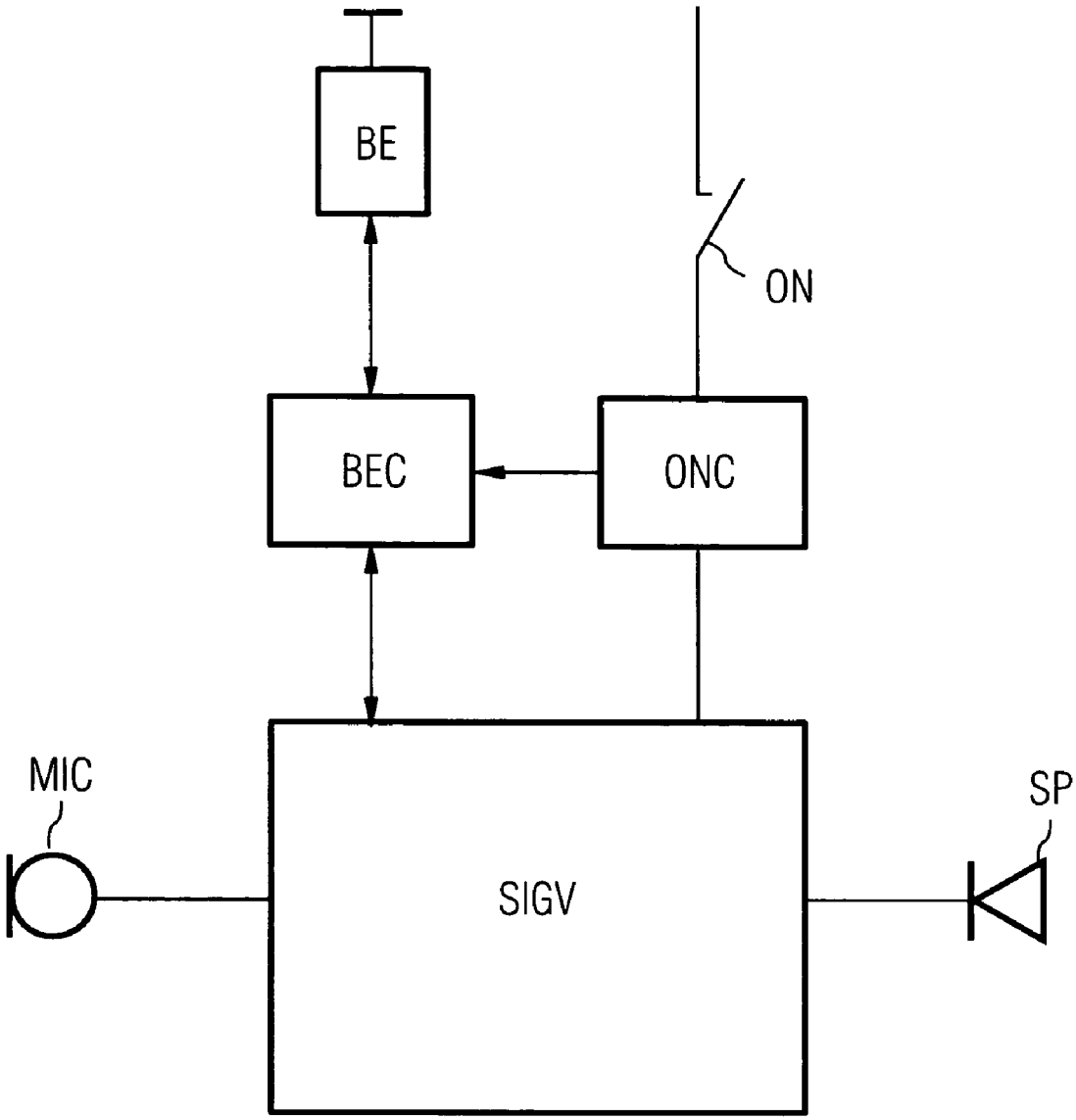
BE
ON
BEC
ONC
MIC
SIGV
SP

METHOD FOR OPERATING A HEARING DEVICE

CROSS REFERENCE TO RELATED APPLICATIONS

This application claims priority of German application No. 10 2007 013 394.6 DE filed Mar. 30, 2007, which is incorporated by reference herein in its entirety.

FIELD OF INVENTION

The present invention pertains to a method for operating a hearing device.

SUMMARY OF INVENTION

On-switches of hearing devices are generally designed such that they are actuated prior to positioning a behind-the-ear hearing device (BTE hearing device) behind the ear and/or inserting an in-the-ear hearing device (ITE hearing device) into the ear. The device is thus already active during this phase of the operation.

In practice, the on-off switch attached to the hearing device is often embodied as a battery compartment switch, i.e. the device is switched off by partially opening the battery compartment and is switched on by closing the battery compartment.

While an initial delay in the activation of the amplification is known to avoid feedback, operation of the device, in particular also after an initial switch-on delay has elapsed, can result in an unintentional adjustment of user-controlled control elements on the device, in particular the loudspeaker controller and program selection button.

With current hearing devices, a switch-on delay of up to 18 seconds to be programmed by the acoustician is provided. During this time, the hearing device outlet (signal output) is muted and/or an optional start melody is played and the control elements (e.g. program switch, loud speaker controller) are deactivated. In practice, this switch-on delay time is often sufficient, particularly with older people, to insert the device. The position of the hearing device is then however frequently corrected again, the hair restyled etc. This often leads to an unintentional adjustment of the control elements. Even if this is indicated by an audio signal (beep), it is still annoying and confusing for the user. In conjunction with learning hearing devices, a faulty interpretation of the user preference can herewith take place (if it is not noticed and immediately corrected). In this context, a delayed switch-on of the audio output would be possible, as a result of which the "confusing" beep is dispensed with, and also the information herefor that a control element has been adjusted.

A general extension of the switch-on delay also fails to appear to adequately solve this problem, as in addition to a delay in the usability of the hearing device, the possibility of rapid function controls is dispensed with, the latter above all in the case of persons, which do not insert the hearing device themselves (children!).

BRIEF DESCRIPTION OF THE DRAWINGS

The invention is described below with reference to the drawing, which includes a FIGURE.

The FIGURE shows the functional structure of a hearing device together with an operating control device BEC according to the invention.

DETAILED DESCRIPTION OF INVENTION

The structure represents the following elements of a hearing device. A microphone MIC, a signal processing device SIGV, a signal output SP (electrocacoustic converter), an on-switch ON, an on-switch control device ONC, a control element BE and an operating control device BEC for controlling the control elements.

Control elements BE of a hearing device can be realized in various manners, e.g. as a button, as a rotating wheel (with or without stop), as a pushbutton, as a two-stage or multi-stage toggle switch or rotary switch, as a sliding switch or as a combined rotary push-button switch, similar to a "mouse wheel" within the field of computers. "Touchpads" or similar elements are also conceivable.

The on-switch control device ONC and the operating control device BEC for controlling control elements are elements, which can be realized both in a hardware-related fashion in the form of electronic circuits as well as in a purely software-related fashion in a microprocessor.

In accordance with the invention and irrespective of a possible on-switch delay, which is effected after actuation of the on-switch ON by the on-switch control device ONC, a separate delay of the release of user-controlled control elements BE attached to the hearing device, (subsequently referred to also as a release delay), which is realized by a device BEC for controlling control elements, is carried out. The duration (span of time) of the said release delay can preferably be adjusted and preferably selected longer than the duration of the on-switch delay. The release delay is also preferably realized in manner so that it can be switched off.

During the delay time of the release delay, the signal detection and processing SIGV in the device already runs in the same way as during normal operation, the signal output SP depends on a switch-on delay which may be present, from which the release delay is realized independently. Ranges between 10 seconds and 2 minutes are allowed for as spans of time for the new delay of the release of control elements. A short audio signal is used (e.g. "volume default" or the beep corresponding to the current program) in order to indicate that the control elements are ready.

In the case of devices with a remote controller, provision can also be made to switch these to standby mode by means of battery compartment switches and then to activate the amplification power by means of remote controllers in one or two steps, and to enable the release of the user-controlled control elements (user controls).

The device BEC can also be embodied to control control elements such that a user-controlled control element (e.g. program switch) is immediately released with a long button press or repeated actuation in a defined time interval ("Double click") or with an actuation of the loudspeaker controller over a certain control range. An adjusted delay can herewith be avoided by the user and an adjustment is performed immediately. A longer button press also constitutes automatic behavior if the hearing device appears to the user not to function because the user has forgotten that the program controller or loudspeaker controller (volume control) is only active after a while. A mechanism of this type can also be used in conjunction with the current switch-on delay in order to make the hearing device immediately ready for use.

The unintentional adjustment of control elements during the insertion of the hearing device is prevented by the inventive delayed activation of the user-controlled control elements, separated from a possible switch-on delay, i.e. a delay in the activation of the amplification and/or signal output.

Control tones and/or the possibilities of immediate activation increase the benefits and user-friendliness of the hearing device.

The invention claimed is:

1. A hearing device, comprising:

a plurality of user control elements configured to generate a respective control activation signal upon actuation by a user of a respective user control element; and an operating control device coupled to the respective user control element to receive the respective control activation signal to realize a release delay configured to delay activation of the respective user control element, wherein the release delay is defined to be independent from a switch-on delay applied to delay activation of an amplifier of the hearing device upon turn-on of the hearing device.

2. The hearing device as claimed in claim 1, wherein the release delay applied by the operating control device is adjustable.

3. The hearing device as claimed in claim 2, wherein a short audio signal is emitted after the release delay applied by the operating control device has elapsed and thus indicating the respective control element is activated.

4. The hearing device as claimed in claim 2, wherein the respective control element is selected from the group consisting of a loud speaker controller and a program selector.

5. The hearing device as claimed in claim 2, wherein the operating control device immediately releases the respective user control element by a user performing a defined operation with a specific control element.

6. The hearing device as claimed in claim 2, wherein a remote controller is configured to activate the respective user control element.

7. A hearing device, comprising:

an amplifier;

at least one user control element configured to generate a control activation signal upon actuation by a user of said at least one control element;

a switch configured to generate a switch-on signal to turn-on the hearing device;

a device responsive to said switch-on signal and configured to apply a switch-on delay;

a signal processor responsive to the switch-on delay to delay activation of the amplifier based on a value of the switch-on delay; and an operating control device coupled to the respective user control element to receive the respective control activation signal to realize a release delay configured to delay activation of the user control element, wherein the release delay is defined to be independent from the switch-on delay.

8. The hearing device as claimed in claim 7, wherein the delay applied by the operating control device is adjustable.

9. The hearing device as claimed in claim 8, wherein the release delay applied by the operating control device is adjusted longer than the switch-on delay.

10. The hearing device as claimed in claim 7, wherein a short audio signal is emitted after the release delay applied by the operating control device has elapsed and thus indicating said at least one control element is activated.

11. The hearing device as claimed in claim 7, wherein the operating control device immediately releases said at least one respective user control element by a user performing a defined operation with a specific control element.

12. The hearing device as claimed in claim 11, wherein the defined operation involves a sustained press on a certain control element or a repeated actuation of a control element within a defined time interval.

13. The hearing device as claimed in claim 11, wherein the defined operation involves an actuation of a loudspeaker controller over a defined control range.

14. The hearing device as claimed in claim 7, wherein the operating control device is embodied such that with a defined operation of a specific control element by the user, the hearing device is as a whole made immediately ready for use.

15. The hearing device as claimed in claim 7, wherein a remote controller is configured to activate the amplifier and to release said at least one user-control element.

16. A method for operating a hearing device, comprising:

storing a switch-on delay;

applying the switch-on delay to delay activation of an amplifier of the hearing device upon turn-on of the hearing device;

storing a release delay;

applying the release delay to delay activation of at least one user control element of the hearing device; and defining the release delay to be independent from the switch-on delay.

17. The method as claimed in claim 16, further comprising emitting a short audio signal after the release delay has elapsed and thus indicating said at least one control element is activated.

18. The method as claimed in claim 16, further comprising immediately releasing a specific control element by a user performing a defined operation with the specific control element.

* * * * *